US005842520A

United States Patent [19]

Bolin

[11] Patent Number: 5,842,520

[45] Date of Patent: Dec. 1, 1998

[54] SPLIT STREAM PUMPING SYSTEM FOR OIL PRODUCTION USING ELECTRIC SUBMERSIBLE PUMPS

[75] Inventor: Kevin Rush Bolin, Sugar Land, Tex.

[73] Assignee: Texaco Inc., White Plains, N.Y.

[21] Appl. No.: 581,862

[22] Filed: Jan. 2, 1996

[51] Int. Cl.[6] ..... E21B 43/38

[52] U.S. Cl. ..... 166/369; 166/106

[58] Field of Search ..... 166/369, 54.1, 166/65.1, 106

[56] References Cited

U.S. PATENT DOCUMENTS

| | | | |
|---|---|---|---|
| 2,281,801 | 5/1942 | Reynolds et al. | 166/106 X |
| 3,199,592 | 8/1965 | Jacob | 166/106 X |
| 5,335,732 | 8/1994 | McIntyre | 166/369 X |
| 5,497,832 | 3/1996 | Stuebinger et al. | 166/106 X |

*Primary Examiner*—William P. Neuder
*Attorney, Agent, or Firm*—Henry H. Gibson; William J. Beard

[57] ABSTRACT

A system for reducing lifting costs in a producing oil well is disclosed. The system employs a casing string set through a production zone having upper producing perforations and lower injection perforations. Dual electric submersible pumps are run in on a tubing string to the production zone and a production packer is set between the producing and injection perforations. Produced fluid is allowed to separate in the casing—production tubing annulus and the first electric submersible pump pumps the separated oil to the surface via the production tubing. The reported water is pumped to the injection perforations below the packer by the second electric submersible pump.

10 Claims, 2 Drawing Sheets

SPLIT STREAM PUMPING SYSTEM FOR OIL PRODUCTION USING ELECTRIC SUBMERSIBLE PUMPS

FIELD OF THE INVENTION

This invention pertains to the production of oil from oil wells and, more particularly, to methods and apparatus for improving the economics of oil production from wells by the prevention of water coning and by lessening the production to the surface of undesired formation water.

BACKGROUND OF THE INVENTION

There has been continuing effort in the petroleum industry to improve the economics of oil production by reducing the lifting costs or cost to the pump produced liquids from downhole to the surface of the earth. Normally, in a producing oil well there is formation water associated with the oil. The production interval typically has in it an oil/water interface. This interface is caused by the gravity separation in the earth formation over geologic time of the lighter oil rising above the formation water. A pressure equilibrium is established across this interface. When a well bore intercepts this producing interval the pressure equilibrium is disturbed. If production perforations are established initially in the oil containing portion of the formation and pressure in the well bore reduced below formation pressure, then oil will flow through the casing perforations into the wellbore where it can be pumped to the surface via any type of desired pump such as a surface powered sucker rod pump or by a submersible electric pump lowered on a tubing string into the production zone.

If the flow rate of fluid from the production zone into the wellbore is too rapid then the effect known as water coning can occur. Water from below the oil portion of the producing zone or formation can rush into the near hole voids created by the too rapid intake of oil through the perforations into the wellbore. The oil/water interface in the production zone is "sucked up" into a completely water bearing cone shaped region near the production perforations and can greatly increase the "water cut" of the produced fluids. It can even "water cut" the oil production completely when there is still a large amount of oil left in the production zone.

Of course, this undesirable coning effect can be avoided by reducing production rates through the perforations in the oil producing zone, but it may be desired even necessary to produce the oil faster. On the other hand, by use of the methods and apparatus of the present invention this undesirable effect can be avoided while simultaneously reducing lifting costs for produced oil from the well, overall.

If produced water is pumped to the surface, then lifting costs are increased. To date efforts to reduce lifting costs in such cases have centered around methods to seal off water producing layers. This is typically done with mechanical devices, such as packers, placed between oil producing perforations and water producing perforations. The location of such perforations may not always be known with precision, however. Also "squeeze cementing" where cement is pumped into the casing-borehole annulus or the formation itself through perforations between the oil producing and water producing zones has been attempted. Again a precise knowledge of the location of the formation oil-water interface is necessary to accomplish this successfully. If this location is not known with precision the squeeze cementing operation can be unsuccessful. While water "coning" has been discussed, it will be understood that this mechanism could be used to control other types of water cut problems such as channeling, fingering or cement wash cut, etc.

BRIEF DESCRIPTION OF THE INVENTION

The present invention takes a different approach to these problems. Regardless of the water production, mechanism produced oil and water are separated downhole using the casing-production tubing annulus as a gravity separator. The separated oil, and only a small portion of produced water, is pumped to the surface by a first electric submersible pump. A second electric submersible pump, powered by the same electric motor, pumps separated produced water through a set of injection perforations below a production packer set in the casing below the production perforations. Thus, the separated water can be returned to the producing formation enabling it to assist in maintaining formation pressure equilibrium during production or disposed of into another separate reservoir.

Lease costs which are directly associated with the volume of total fluid lifted and handled from a producing well are substantially reduced. A reduction in the volume of fluid lifted and handled from the well also results in a lowering of horsepower required to operate the well since only oil, and a small fraction of produced water, are actually lifted to the surface. Similarly, water injection costs, water treating costs, spill containment and cleanup costs are substantially reduced by use of the present invention.

The present invention also has application with respect to water flooding deeper producing zones in more mature fields. This can be accomplished by the use of production water from shallower zones in the well being injected through former production perforations in the deeper zone desired to be water flooded. This can reduce costs in the drilling of injection wells. It can also affect the location and number of oil wells, injection facility size, reservoir size, pipeline location, and other factors. The subject invention can allow small scale floods or pattern reconfiguration, due to the utility of a single wellbore, and reducing the costs of surface facilities needed.

The above and other features and advantages of the present invention will be best understood by reference to the following detailed description thereof taken in conjunction with the appended drawings. These descriptions and drawings are intended as illustrative of the invention, and not as limitative.

DETAILED DESCRIPTION OF THE INVENTION

Figure 1:
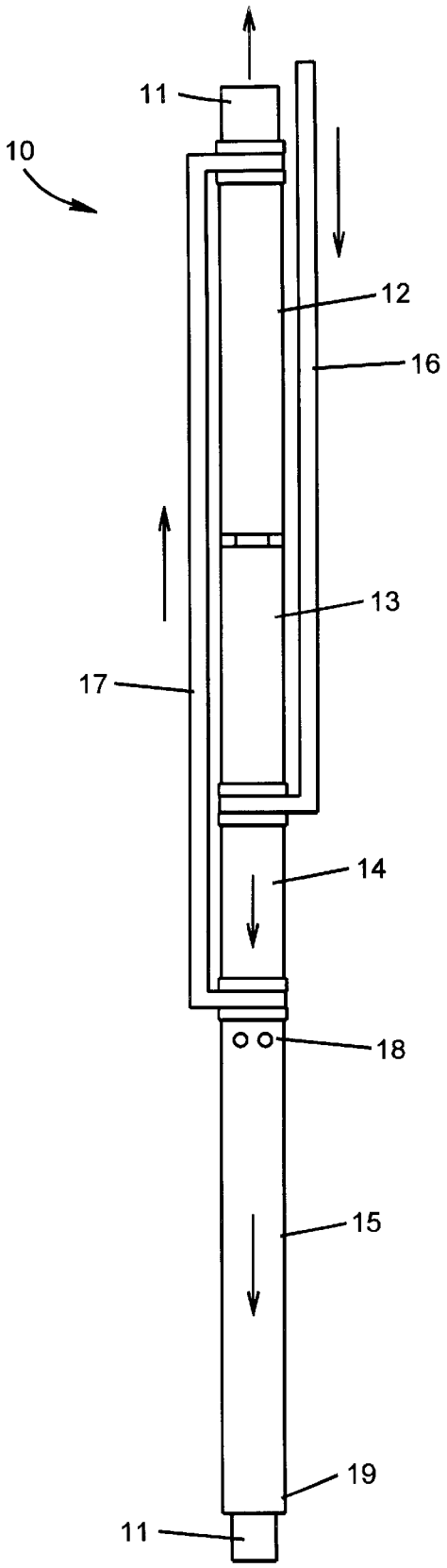
FIG. 1. illustrates schematically a pumping system according to the present invention with dual electric submersible pumps mounted below an electric motor.
Figure 2:
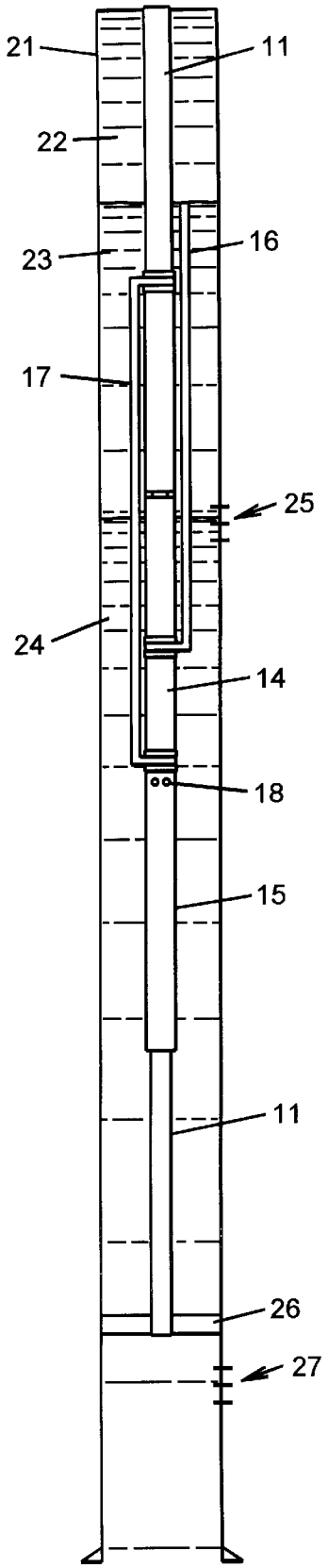
FIG. 2. which illustrates schematically the pumping system of FIG. 1 deployed in a producing wellbore.

Referring initially to FIGS. 1 and 2 a first embodiment of a pumping system according to the concepts of the present invention is illustrated schematically standing alone (FIG. 1) and deployed in a wellbore producing oil and water (FIG. 2).

A steel well casing 21 is cemented in place over the producing interval (not shown explicitly). The casing 21 has upper production perforations 25 and lower injection perforations 27. A production packer 26 seals off the production perforations 25 from fluid communication inside the casing 21, with the injection perforations 27. It will be understood by those of skill in the art, however, that fluids produced into the casing 21 through perforations 25 and fluids injected through perforations 27 can influence the flow parameters of each other since these perforations are in pressure (and perhaps fluid) communication with each other via the earth formations exterior to casing 21.

A pumping system depicted generally at 10 (FIG. 1) is run into the producing zone on production tubing 11 which extends to the surface of the earth. It will be understood by those skilled in the art that an electric wireline (not shown) can extend from the surface down the production tubing 11 to power the pumping system 10. In the embodiment shown in FIGS. 1 and 2 an electric motor 12 and motor protector 13 comprising oil seals from borehole pressures are mounted above the dual electric submersible pumps 14 and 15. Electric motor 12 and protector 13 are shaft connected to a first electric submersible pump 14 and a second electric submersible pump 15 mounted below it. The production tubing 11 extends below second pump 15 routing its discharge via tubing 11 to a set of injection perforations 27 located below the production packer 26.

The discharge line 17 of the first electric submersible pump 14 is routed into production tubing 11 at a point above the electric motor 12 and routes fluid discharge from the first pump 14 to the surface via tubing 11. The fluid intake line 16 for the first pump 14 is situated substantially up the tool string from the fluid intake openings 18 for the second pump 15. Thus the configuration shown in FIGS. 1 and 2 acts to receive input fluid from uphole via input line 16 and route this fluid to the surface via the first pump 14 and its discharge line 17 into tubing string 11. Input fluid from lower in the hole is received via the second pump 15 and its fluid inlet 18 and is routed below packer 26 via lower tubing 11 to injection perforations 27. Here it is re-injected into the producing formation via lower tubing string 11.

In operation fluids are produced from the production zone via perforations 25 into the casing above the packer 26. The casing 21 tubing 11 annulus above the packer 26 serves as a gravity separator for the produced fluid. The lighter fluids (mostly oil) rise to the top as shown at layer 22. Heavier fluids such as produced water settle lower in the casing 21 as shown at layer 24. Intermediate layer 23 contains mixed oil and water in roughly the ratio produced through the production perforations 25.

Figure 3:
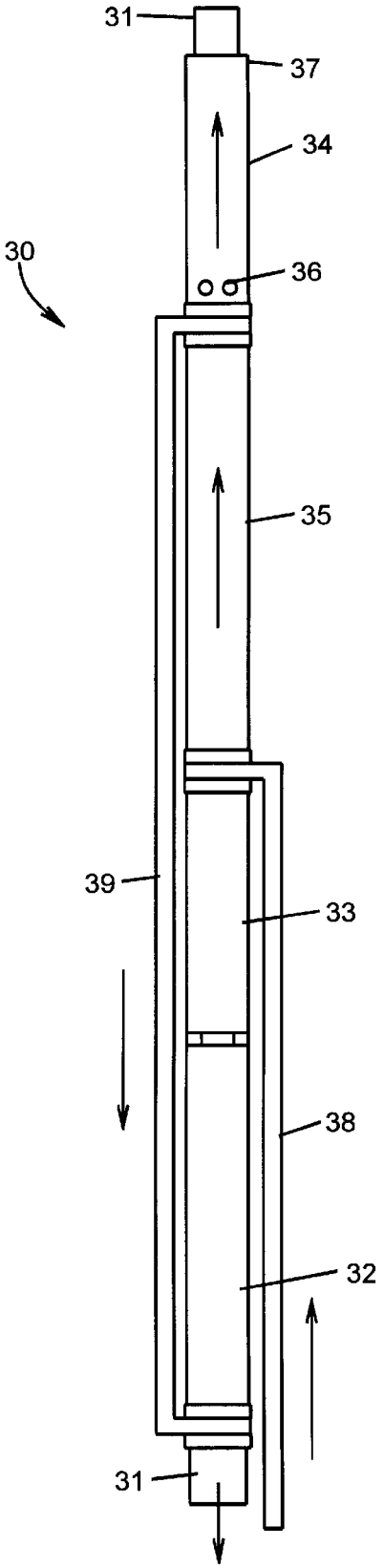
FIG. 3 illustrates schematically a pumping system according to the invention with dual electric submersible pumps mounted above an electric motor, and FIG. 4. which illustrates schematically the pumping system of FIG. 3 deployed in a producing wellbore.
Figure 4:
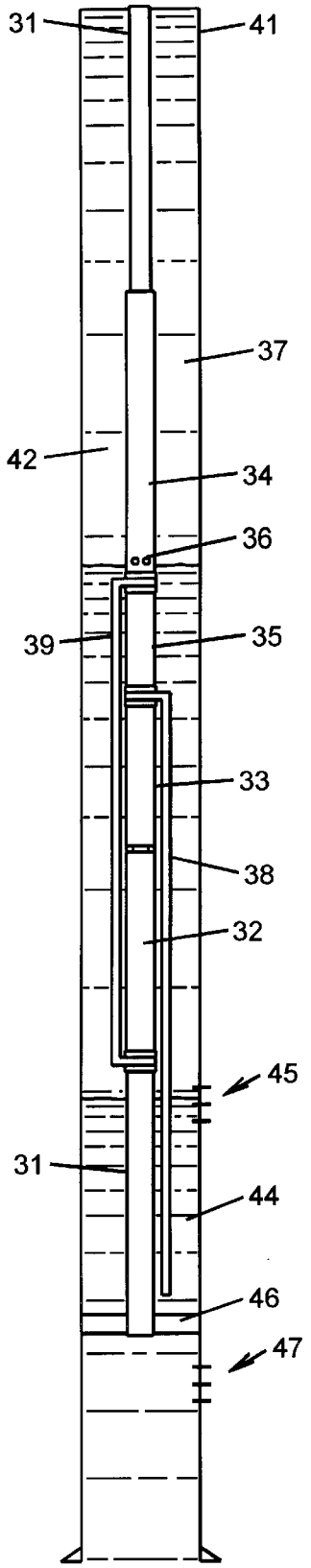

Referring now to FIGS. 3 and 4 a second embodiment of a pumping system according to the concepts of the invention is shown schematically. In the embodiment shown in FIGS. 3 and 4 an electric motor 32 and motor protector 33 are shown mounted below dual electric submersible pumps 34 and 35. Again the electric motor 32 and motor protector 33 are coaxially shaft connected to a first submersible pump 34 and a second submersible pump 35 mounted below it. The production tubing string 31 extends to the surface above the pumping assembly (shown generally as 30). The tubing 31 also extends below the pumping assembly 30 through a production packer 46 which seals the upper portion of the casing 41 interior from the lower portion thereof. This lower portion of tubing string 31 receives the discharge line 39 from the second pump 35 and conducts fluid thereby via tubing 31 below packer 46 for re-injection into the production zone via injection perforations 47.

Input mixed fluid (layer 43) produced from the production zone via production perforations 45 is gravity separated into oil an layer 42 and a water layer 44 inside casing 41 under the influence of gravity. Input fluid (primarily water) to the second pump 35 is picked up by its intake line 38 from the lower layer 44 comprising mostly the heavier water. Discharge from the second pump 35 is via its discharge line 39 to tubing string 31 below the assembly 30.

Input fluid (primarily oil) to the first pump 34 is picked up from the lighter water oil layer 42 via its fluid intake 36. This fluid is routed to the surface via the first pump 34 and its discharge line 37 into production tubing 31 to the surface. In operation, fluid from the production zone enters the casing 41 via production perforations 45. The casing 41—production tubing 31 annulus acts as a gravity separator separating the generally mixed water and oil produced fluid (layer 43) into a lower water layer 44 and an upper oil layer 42. Oil is picked up and pumped to the surface by the first electric submersible pump 34 (its intake 36 and discharge 37). Water is picked up (via its intake 38) by the second electric submersible pump 35 and routed via its discharge line 39 and tubing 31 to below packer 46 and re-injected into the earth formations via injection perforations 47.

The different geometrical configuration of the arrangements of FIGS. 1 and 2 and FIGS. 3 and 4 result from such practical considerations as desired production rates, injection rates, and distance apart of production and injection perforations. The entire pumping assembly 10 (FIG. 1) or 30 (FIG. 3) may typically be 30 to 40 feet in length. Distance from perforations to packers, percentage of water cut and injection rate and designed production rate can decide whether it is desirable to place the electric submersible pumps above or below the electric motor in the tool array. While not shown, it is also possible to arrange a dual shafted electric motor to drive one electric submersible pump above, and one electric submersible pump below the motor if desired. Such a configuration could also prove useful in some wells, depending on the flow dynamics of that well.

In summary, the present invention uses the casing-tubing annulus above a packer as a gravity separator for produced fluids. A production packer is set between upper producing perforations and lower injection perforations and fluid enters the casing from the production perforations. A first electric submersible pump and its associated intake and discharge lines are arranged to pull in fluid (primarily oil) from the upper portion of the annulus and route it to the surface via the production tubing string. A second electric submersible pump and its associated intake and discharge lines are arranged to pull in separated fluid (primarily water) from the lower portion of the annulus and to re-inject this fluid via injection perforations located below the packer.

While particular embodiments of the invention have been shown and described herein, these may make other alternative arrangements within the scope and concept of the invention apparent to those of skill in the art. It is the aim of the appended claims to cover any and all such alternatives as fall within the true spirit and scope of the invention.

We claim:

1. A method for improving the economics of production from a producing oil well by reducing lifting costs comprising the steps of:

placing a casing string downhole through a production zone in a well borehole;

placing a production tubing string extending downwardly through said casing and forming an annulus therebetween;

placing upper production perforations and lower injection perforations in said casing string in upper and lower portions of said production zone;

placing a single production packer in said casing string between said production perforations and said injection perforations;

producing mixed oil and water fluids into said casing-tubing annulus through said production perforations and allowing said produced fluids to collect in said annulus above said production packer and to separate into an oil layer and a water layer under the influence of gravity;

pumping with a first electric submersible pump, fluid from said oil layer to the surface of the earth via said production tubing; and pumping with a second electric submersible pump water from said water layer into said injection perforations below said packer for injection back into said production zone.

2. The method of claim 1 where the inlet to said first electric submersible pump is located primarily in said oil layer and its discharge is connected to said production tubing and where the inlet to said second submersible pump is located primarily in said water layer and its discharge is connected below said packer.

3. The method of claim 2 wherein both of said electric submersible pumps are driven by a single electric motor, said motor having a coaxially aligned driven shaft common to both pumps.

4. The method of claim 3 wherein both pumps are located uphole of said single electric motor.

5. The method of claim 3 wherein both pumps are located downhole of said single electric motor.

6. The method of claim 2 wherein both of said electric submersible pumps are driven by a single electric motor said motor having an upper drive shaft and a lower drive shaft and being placed in coaxial alignment with said pumps and located therebetween.

7. A system for improving the economics of production from a producing oil well by reducing lifting costs, comprising:

a casing string extending downhole in a well borehole penetrating a production zone therein;

upper production perforations and lower injection perforations in said casing string placed respectively in upper and lower portions of said production zone;

a production packer placed in said casing string between said upper and lower perforations;

a production tubing string run into the wellbore through said casing string and carrying thereon;

an electric motor and power cable therefor and a first electric submersible pump powered thereby and having its fluid intake located in the annulus between said casing and said tubing string above said production perforations and said packer and its discharge into said tubing string to the earth's surface, and a second electric submersible pump powered by said motor and having its fluid intake located in the annulus between said casing and said tubing string below said production perforations and above said packer and its discharge tube routed below said packer, whereby produced fluids are separated into oil and water layers in the casing-tubing annulus and primarily oil is pumped to the surface and primarily water is pumped below said packer and back into the production zone via said injection perforations.

8. The system of claim 7 wherein both pumps are located uphole of said electric motor.

9. The system of claim 7 wherein both pumps are located downhole of said electric motor.

10. The system of claim 7 and further including a pump protector means located between said motor and said pumps.

* * * * *